US006315427B1

(12) United States Patent
Simon

(10) Patent No.: US 6,315,427 B1
(45) Date of Patent: Nov. 13, 2001

(54) INTUITIVE BEAM DIRECTING CONTROL DEVICE FOR USE IN LIGHT CONVEYANCE SYSTEM

(76) Inventor: Jerome H. Simon, 70 Sumner St., Newton Centre, MA (US) 02159

( * ) Notice: Subject to any disclaimer, the term of this patent is extended or adjusted under 35 U.S.C. 154(b) by 0 days.

(21) Appl. No.: 09/195,848

(22) Filed: Nov. 19, 1998

Related U.S. Application Data

(60) Provisional application No. 60/065,489, filed on Nov. 19, 1997.

(51) Int. Cl.[7] ..... F21S 8/00

(52) U.S. Cl. ..... 362/147; 362/277; 362/283; 362/284; 362/319; 362/322; 362/324; 359/223; 359/225; 359/872

(58) Field of Search ..... 362/147, 277, 362/282, 319, 322, 323, 324, 419, 287, 284, 576, 283; 359/223, 225, 226, 547, 876, 872

(56) References Cited

U.S. PATENT DOCUMENTS 4,504,894 * 3/1985 Reibling ..... 362/296
5,497,295 * 3/1996 Gehly ..... 362/32
5,815,302 * 9/1998 Mc Vey et al. ..... 359/214
5,911,499 * 6/1999 Stafford ..... 362/240

* cited by examiner

*Primary Examiner*—Sandra O'Shea
*Assistant Examiner*—Bertrand Zeade
(74) *Attorney, Agent, or Firm*—Harvey Kaye; Jerry Cohen; Perkins, Smith & Cohen, LL

(57) ABSTRACT

A device for lighting arrangements for a ceiling, includes means providing a light beam above a ceiling, reflector means for intercepting and reflecting light beams and located above the ceiling, means for mounting the reflector means for movement around two orthogonal axes and located above the ceiling, and remote movement means located above the ceiling for moving the reflector means selectively about the two orthogonal axes from a remote location to reflect the light beam to a location below the ceiling. The remote movement means has a control handle located below the ceiling. An arrangement can be provided so that there are a plurality of reflector means aligned to receive the light beam, and all but the last reflector means is a beam splitter.

16 Claims, 3 Drawing Sheets

INTUITIVE BEAM DIRECTING CONTROL DEVICE FOR USE IN LIGHT CONVEYANCE SYSTEM

CROSS-REFERENCE TO RELATED APPLICATIONS

This application is based upon Provisional Application Serial No. 60/065,489 filed Nov. 19, 1997.

FIELD OF THE INVENTION

The present invention relates generally to the lighting field, and, more particularly, to a device for changing the direction of a light beam by rotating a reflective surface which is in the path of the beam.

SUMMARY OF THE INVENTION

An object of the present invention is to provide a device which changes the direction of a light beam (or beams of other frequencies of electromagnetic energy) by rotating a reflective surface within the pathway of the beam.

Another object of the present invention is to provide manual control of the rotation of such a reflecting surface remote from the actual reflecting surface so that the reflecting surface can be placed above the plane of a ceiling while the manual controlling device may be placed below (on the other side of) the ceiling plane.

A further object of the present invention is to provide manual control in the same direction of movement of the reflected beam. A still further object of the present invention is to provide for remote manual control of the position of a reflecting surface in all directions

DESCRIPTION OF THE PREFERRED EMBODIMENTS

The preferred embodiments of the present invention are described in connection with the drawings.

Figure 1:
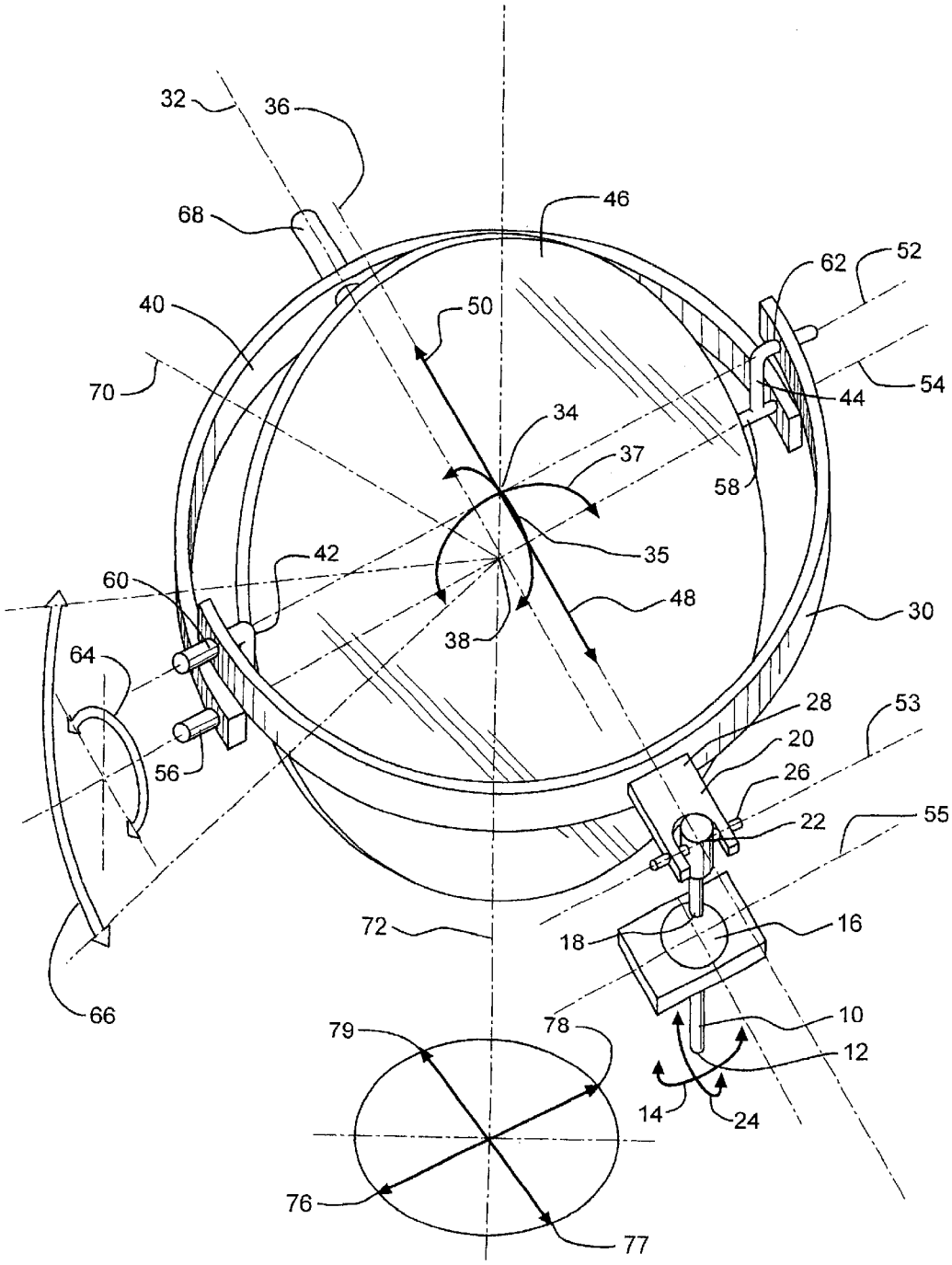
FIG. 1 is an isometric view of a beam directing device in which a moveable reflective element used to change the direction of a beam is actuated by a mechanism.

FIG. 1 is an isometric view of a device which provides changes to a reflecting surface along two orthogonal axes, somewhat in the nature of a gimbal. However, a mechanism is provided which transfers manually derived force which is applied to a handle or lever to the movement of a reflecting device, thereby changing the direction of a beam of light. The direction of the reflected beam of light is in direct relationship with the movement of the lever depicted.

The reflector has a longitudinal axis and a lateral axis orthogonal therewith and is mounted for movement about each axis so that the reflector may be placed into a continuously variable position from one extreme to the other and thus reflected light beams into the desired direction from any of its positions.

The reflector is controlled by a remote manual moving mechanism so that the beam can be directed where desired. Therefore, in one application of the present invention, the reflector may be part of a remote lighting system and receives light beams from another location and is located above the ceiling in a room. The control handle for moving the reflector is below the ceiling. Thus, the handle is accessible to persons in the room who may adjust the reflector to provide light at a desired location.

As a force is applied to manual adjustment lever or handle 10 at off-axis point 12 in clockwise or counterclockwise orbit on arc 14 (around ball joint 16 centered at point 18), hinge pin mechanism 20 (connected to handle 10 at off-axis point 22) orbits on arc 14 in a clockwise or counterclockwise direction, respectively.

As force is applied to manual adjustment lever 10 at off-axis point 12 in a clockwise or counterclockwise motion on arc 24 (around ball joint 16 centered at point 18), hinge pin mechanism 20 orbits on arc 24 in a clockwise or counterclockwise direction, respectively.

Arcs 35 and 37 show the movement of the reflector which is similar to that of point 22 on the handle mechanism.

Hinge pin mechanism 20 (comprised of hinge pin 26 which is attached through handle 10 at 22, and connection bearing 28) is attached to off-axis ring 30.

As force is applied to manual adjustment lever 10 in a clockwise or counterclockwise motion on arc 14, the off-axis centerline of off-axis ring 30 is made to orbit (in a parallel degree of freedom) diagonal axis 32. This orbit is graphically depicted as off-axis point 34 (on diagonal off axis 36), orbiting stationary point 38 (on diagonal axis 32).

Since off-axis ring 30 is connected to support ring 40 (by radial pivot rods 42 and 44), the orbiting of 30 causes the rotation of support ring 40 and beam reflector 46 in the degree of freedom as described in "Rotation of the Beam Directing Reflector" which follows below.

Axis 53 is the axis of pin 26 and axis 55 is the parallel axis of the ball 16. As force is applied to manual adjustment lever 10 in a clockwise or counterclockwise motion on arc 24, off-axis ring 30 is caused to move in the directions 48 and 50 respectively, in turn causing the meridian of- axis 52 to orbit meridian off-axis 54 (in a parallel degree of freedom). Radial pivot rods 42 and 44, fixed to and radiating from meridian bearing 56 and 58, respectively, attach to off-axis ring 30 at bearing points 60 and 62, respectively. Rotational movement of bearing points 60 an 62 (corresponding to the orbit of 52 around 54) causes the rotation of 56 and 58, and therefore the rotation of beam directing reflector 46 in the degree of freedom as described in "Rotation of the Beam Directing Reflector," which follows. The movement of axes 53 and 55 is always parallel to axes 52 and 54.

Rotation of the Beam Directing Reflector

The beam directing reflector 46 is able to rotate around primary pivot point 38 as a result of two rotational degrees of freedom. These two degrees of freedom are the rotation of the beam directing reflector 46 around primary diagonal axis 32 and the rotation of 46 around meridian axis 54. Rotation of 46 around 32 is represented by graphic arrow 66. Rotation of 46 around 54 is represented by graphic arrow 64. Mechanically the rotation of 46 is achieved as follows.

Reflector 46 is attached to meridian bearings 56 and 58 which turn in support ring 40. This allows the reflector 46 to rotate on axis 54. Support ring 40 turns on bearing 68, which allows reflector 46 to rotate on axis 32.

FIG. 1 graphically depicts the direction of the reflected beam as it is directed by rotation of beam directing reflector 46.

A circle is shown below the device to symbolically represent the movement of the reflected beam as the reflector is moved. Thus, as manual force is applied to handle 10 in a counterclockwise direction along arc 14, beam center 70 reflected off reflector 46, as reflected beam 72, moves from position 76 to position 78. Also, as the handle 10 is moved in a direction along arc 24 toward the reflector, beam center 70 reflected off reflector 46, as reflected beam 72, moves from position 77 to position 79.

Figure 2:
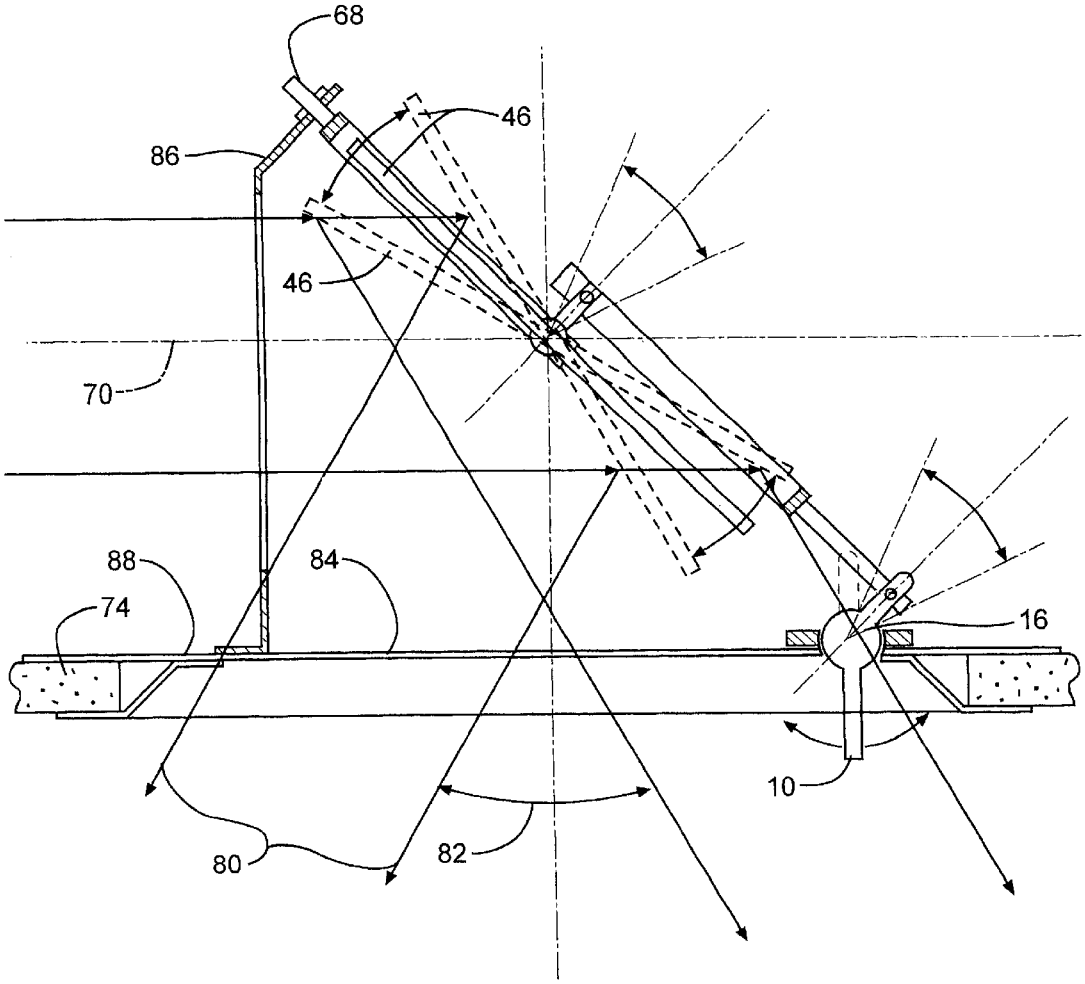
FIG. 2 is an elevational view of FIG. 1 with the addition of light pathways and the beam directing device's attachment to elements of a light conveyance system.

FIG. 2 is a cross sectional view of the device that depicts the device mounted to a ceiling tile 74 in which a hole has been cut to allow reflected beam 80 to pass through at variable predetermined angles 82. A plate 84 (which may be transparent or of various degrees of diffusion) acts as a dust barrier between reflector 46 and the space below the ceiling.

Bearing support 86 (attached to support plate 88) supports and acts as a bearing sleeve to bearing 68. Support plate 88 acts as a "frame" to support and provide fixed dimensional placement between ball bearing 16 (with lever or handle 10) and bearing sleeve 86.

Figure 3:
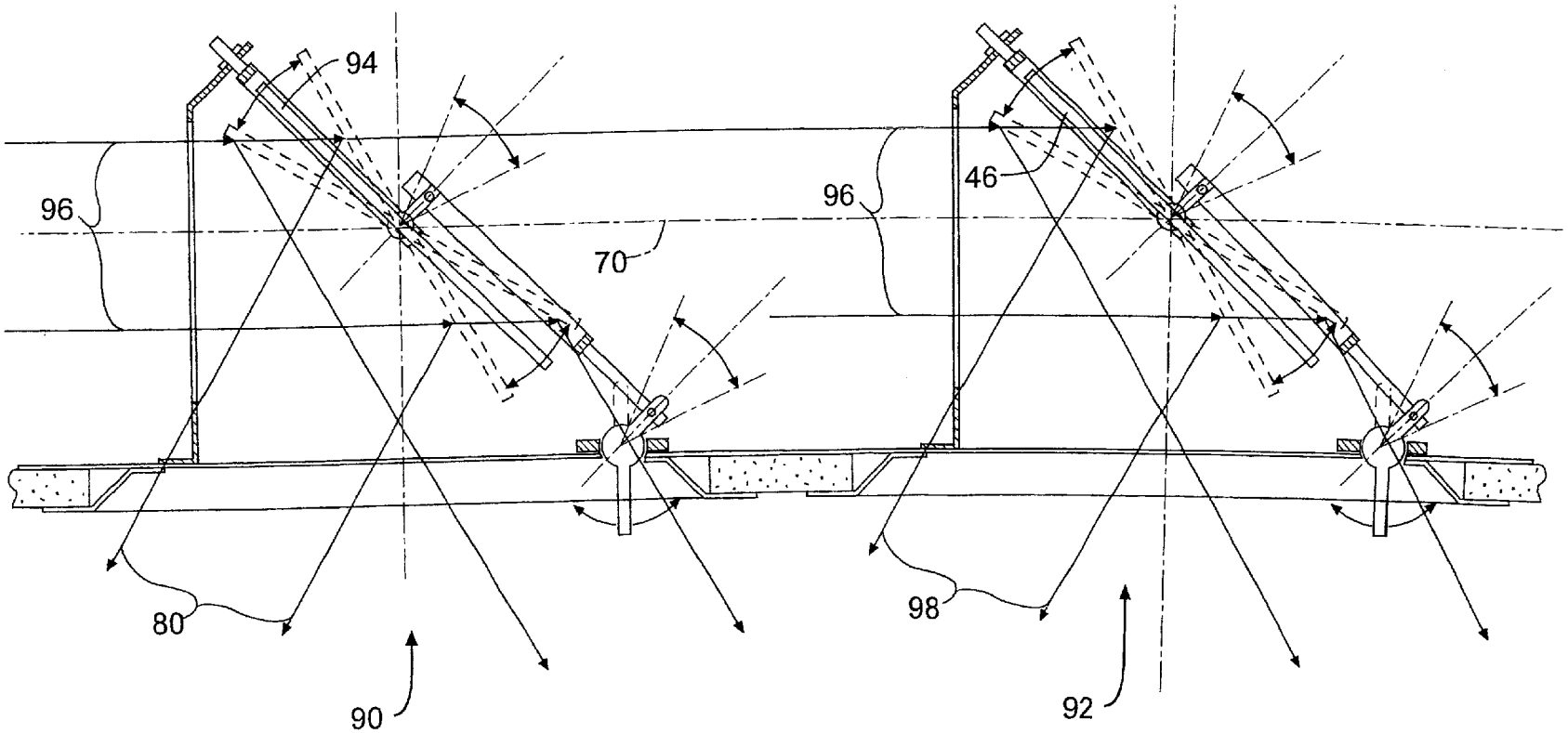
FIG. 3 is an elevational view of a system utilizing a multiple of the such devices (as in FIG. 2) for the purposes of dividing a primary beam into multiple secondary beams, and in turn providing directability to each of the secondary beams.

FIG. 3, illustrates two of the devices 90 and 92, both aligned on central beam axis 70. The beam directing reflector device 90, (which supports and moves beam splitter 94) is a beam splitter that directs a predetermined percentage of light beam 96 as reflected rays 80, and allows the remaining percentage (of light beam 96) to travel to device 92 where it is reflected by the full reflecting surface of 46 as reflected beam 98.

Although two devices are illustrated in FIG. 3, three or more devices may be used (aligned as shown) to provide a multiple of reflected beams from a single light beam as depicted as 96 and which is provided by a suitable light source (not shown).

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A device for lighting arrangements, comprising:

reflector means for intercepting and reflecting light beams;

means for mounting and articulating said reflector means for movement around two orthogonal axes; and remote movement means for moving said reflector means selectively about the two orthogonal axes from a remote location, said remote movement means being connected with said mounting means so that the reflector means moves a beam of light in the same direction as the remote movement means to provide intuitive use thereof.

2. A device for lighting arrangements, comprising reflector means for intercepting and reflecting light beams;

means for mounting and articulating said reflector means for movement around two orthogonal axes, the reflector means and mounting means being located above a ceiling; and remote movement means for moving said reflector means selectively about the two orthogonal axes from a remote location, said remote movement means being connected with said mounting means so that the reflector means moves a beam of light in the same direction as the remote movement means to provide intuitive use thereof, and the remote movement means having a control handle disposed below the ceiling.

3. A device as defined in claim 1 wherein the light beams to be reflected are located above the ceiling and the reflected light beam is directed below the ceiling.

4. A device as defined in claim 3 wherein there are a multiplicity of such devices arranged in a row.

5. A device as defined in claim 4 wherein all but the last of such devices have reflector means which are beam splitters.

6. A device for lighting arrangements for a ceiling, comprising:

means providing a light beam above a ceiling;

reflector means for intercepting and reflecting light beams and located above the ceiling;

means for mounting said reflector means for movement around two orthogonal axes and located above the ceiling; and remote movement means located above the ceiling for moving said reflector means selectively about the two orthogonal axes from a remote location to reflect the light beam to a location below the ceiling, said remote movement means having a control handle located below the ceiling, said remote movement means being connected with said mounting means so that the reflector means moves a beam of light in the same direction to provide intuitive use thereof.

7. A device as defined in claim 6 wherein there are a plurality of reflector means aligned to receive the light beam, and all but the last reflector means is a beam splitter.

8. A device as defined in claim 1 wherein the centerpoint of the orthogonal axes intercept at the center of rotation of the reflector means and allows the reflector means to rotate about a single point.

9. A device as defined in claim 6 wherein the centerpoint of the orthogonal axes intercept at the center or rotation of the reflector means and allows the reflector means to rotate about a single point.

10. A device as defined in claim 8 wherein the mounting means includes at least one gimbal.

11. A device as defined in claim 9 wherein the mounting means includes at least one gimbal.

12. A device as defined in claim 1 wherein the control means is a single lever and/or a ball.

13. A device as defined in claim 6 wherein the control means is a single lever and/or a ball.

14. A device as defined in claim 1 wherein the remote control is a mechanical linkage.

15. A device as defined in claim 6 wherein the movement of the reflector around its axis corresponds in direction to the movement of the ball around its axis.

16. A device for lighting arrangements, comprising:

a support plate;

reflector means for intercepting and reflecting light beams and located on one side of said support plate;

means for mounting and articulating said reflector means for movement around two orthogonal axes, said mounting and articulating means being connected to said support plate, at least partially supported thereby, and located on said one side thereof; and remote movement means for moving said reflector means selectively about the two orthogonal axes from a remote location, said remote movement means being connected with said mounting means so that the reflector means moves a beam of light in the same direction as the remote movement means to provide intuitive use thereof, said remote movement means being on the other side of said support plate from said reflector means and said mounting and articulating means.

* * * * *